US007410740B2

(12) United States Patent
Nakayama et al.

(10) Patent No.: US 7,410,740 B2
(45) Date of Patent: Aug. 12, 2008

(54) MAGNETIC TONER FOR TWO COMPONENT DEVELOPER AND IMAGE FORMING METHOD USING THE SAME

(75) Inventors: Yukinori Nakayama, Minamigacka Tsu Mie (JP); Kouzou Teramoto, Higashosaka (JP); Kousuke Satou, Sone Ise Mie (JP); Hiroshi Mizuhata, Wakayama (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 11/376,623

(22) Filed: Mar. 15, 2006

(65) Prior Publication Data

US 2006/0216622 A1 Sep. 28, 2006

(30) Foreign Application Priority Data

Mar. 18, 2005 (JP) ..... 2005-080673

(51) Int. Cl.
*G03G 9/00* (2006.01)

(52) U.S. Cl. ..... 430/108.1; 430/113.1

(58) Field of Classification Search ..... 430/108.1, 430/111.3

See application file for complete search history.

(56) References Cited

U.S. PATENT DOCUMENTS 6,285,841 B1 * 9/2001 Miho ..... 399/55
6,653,036 B1 * 11/2003 Tanikawa et al. ..... 430/106.2
2004/0053153 A1 * 3/2004 Yaguchi et al. ..... 430/106.1

FOREIGN PATENT DOCUMENTS

| | | | |
|---|---|---|---|
| JP | 9-59024 | A | 3/1997 |
| JP | 11-153882 | A | 6/1999 |
| JP | 2000-162817 | A | 6/2000 |
| JP | 2000-242029 | A | 9/2000 |

* cited by examiner

*Primary Examiner*—Mark F. Huff
*Assistant Examiner*—Peter L Vajda

(57) ABSTRACT

The developer comprises magnetic toners and the magnetic carriers which forms magnetic ears on the surface of the developing roller. The magnetic toner is of an average particle size 0.01 μm through 0.50 μm and is of octahedron shape that is a convex polyhedron surrounded by eight triangles as a basis, each of the vertexes edges of the octahedron shape toner being in a curved surface shape and having a portion that can be taken as a straight line on the outer periphery of a projected image of the octahedron shape toner. The magnetic ears are electrically charged by the friction between the magnetic toner and the magnetic carriers and the magnetic ears on the developing roller are carried to the electrostatic latent image on the photoreceptor. The latent image is developed by the magnetic toners in the magnetic ears, in a small gap between the developing roller and the photoreceptor.

13 Claims, 9 Drawing Sheets

FIG. 5

| | SHAPE | NORMAL TEMP. NORMAL HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| EX. 1 | T 8 | 18.9 | 20.5 | 1.42 | 1.40 | ○ | ○ | ○ |
| REF. 1 | P 8 | 12.7 | 12.9 | 1.39 | 1.38 | △ | × | × |
| REF. 2 | ST 8 | 12.9 | 13.5 | 1.37 | 1.37 | △ | × | × |
| REF. 3 | P 4 | 13.6 | 12.5 | 1.42 | 1.40 | △ | × | × |
| REF. 4 | ST 4 | 14.7 | 13.2 | 1.40 | 1.37 | △ | × | △ |
| REF. 5 | T 4 | 20.7 | 30.8 | 1.35 | 1.02 | ○ | △ | ○ |
| REF. 6 | SPH | 22.2 | 39.5 | 1.32 | 1.00 | ○ | ○ | ○ |

FIG. 6

| | SHAPE | HIGH TEMP. HIGH HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| EX. 1 | T 8 | 17.1 | 19.2 | 1.43 | 1.42 | ○ | ○ | ○ |
| REF. 1 | P 8 | 11.2 | 10.5 | 1.39 | 1.37 | △ | × | × |
| REF. 2 | ST 8 | 12.0 | 11.6 | 1.38 | 1.37 | △ | × | × |
| REF. 3 | P 4 | 12.3 | 13.1 | 1.41 | 1.39 | △ | × | × |
| REF. 4 | ST 4 | 13.2 | 12.4 | 1.42 | 1.38 | △ | × | × |
| REF. 5 | T 4 | 18.8 | 29.0 | 1.37 | 1.05 | ○ | △ | ○ |
| REF. 6 | SPH | 18.9 | 31.5 | 1.35 | 1.04 | ○ | ○ | ○ |

FIG. 7

| | SHAPE | LOW TEMP. LOW HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| EX. 1 | T 8 | 20.2 | 21.8 | 1.40 | 1.39 | ○ | ○ | ○ |
| REF. 1 | P 8 | 14.1 | 13.8 | 1.36 | 1.35 | △ | × | × |
| REF. 2 | ST 8 | 14.5 | 14.1 | 1.37 | 1.35 | △ | × | × |
| REF. 3 | P 4 | 15.0 | 14.9 | 1.38 | 1.36 | △ | × | △ |
| REF. 4 | ST 4 | 15.9 | 16.5 | 1.38 | 1.37 | △ | △ | △ |
| REF. 5 | T 4 | 22.8 | 36.4 | 1.35 | 0.97 | ○ | ○ | ○ |
| REF. 6 | SPH | 25.1 | 42.3 | 1.32 | 0.93 | ○ | ○ | ○ |

FIG. 8

| | SHERICITY | NORMAL TEMP. NORMAL HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| REF. 7 | 0.88 | 21.5 | 27.6 | 1.37 | 1.25 | ○ | ○ | ○ |
| EX. 2 | 0.92 | 19.9 | 21.0 | 1.39 | 1.34 | ○ | ○ | ○ |
| EX. 1 | 0.95 | 18.9 | 20.5 | 1.42 | 1.40 | ○ | ○ | ○ |
| EX. 3 | 0.98 | 17.5 | 18.8 | 1.40 | 1.39 | ○ | ○ | ○ |
| REF. 1 | 1 | 12.7 | 12.9 | 1.39 | 1.38 | △ | × | △ |

FIG. 9

| | SHERICITY | HIGH TEMP. HIGH HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| REF. 7 | 0.88 | 20.1 | 26.8 | 1.39 | 1.27 | ○ | △ | ○ |
| EX. 2 | 0.92 | 18.5 | 19.7 | 1.43 | 1.36 | ○ | ○ | ○ |
| EX. 1 | 0.95 | 17.1 | 19.2 | 1.43 | 1.42 | ○ | ○ | ○ |
| EX. 3 | 0.98 | 16.8 | 18.9 | 1.42 | 1.40 | ○ | ○ | ○ |
| REF. 1 | 1 | 11.2 | 10.5 | 1.39 | 1.37 | △ | × | × |

FIG. 10

| | SHERICITY | LOW TEMP. LOW HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| REF. 7 | 0.88 | 22.2 | 31.5 | 1.36 | 1.22 | ○ | △ | ○ |
| EX. 2 | 0.92 | 20.8 | 23.2 | 1.38 | 1.36 | ○ | ○ | ○ |
| EX. 1 | 0.95 | 20.2 | 21.8 | 1.40 | 1.39 | ○ | ○ | ○ |
| EX. 3 | 0.98 | 18.2 | 19.6 | 1.41 | 1.38 | ○ | ○ | ○ |
| REF. 1 | 1 | 14.1 | 13.8 | 1.36 | 1.35 | △ | × | △ |

FIG. 11

| | AVERAGE SIZE [μm] | NORMAL TEMP. NORMAL HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| REF. 8 | 0.005 | 14.5 | 13.2 | 1.37 | 1.34 | ○ | △ | × |
| EX. 4 | 0.05 | 18.2 | 18.9 | 1.43 | 1.45 | ○ | ○ | ○ |
| EX. 1 | 0.20 | 18.9 | 20.5 | 1.42 | 1.40 | ○ | ○ | ○ |
| EX. 5 | 0.37 | 19.5 | 22.0 | 1.40 | 1.37 | ○ | ○ | ○ |
| REF. 9 | 0.73 | 22.4 | 34.8 | 1.35 | 1.04 | ○ | ○ | ○ |

FIG. 12

| | AVERAGE SIZE [μm] | HIGH TEMP. HIGH HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| REF. 8 | 0.005 | 13.0 | 12.5 | 1.39 | 1.35 | △ | × | × |
| EX. 4 | 0.05 | 16.5 | 17.8 | 1.45 | 1.43 | ○ | ○ | ○ |
| EX. 1 | 0.20 | 17.1 | 19.2 | 1.43 | 1.42 | ○ | ○ | ○ |
| EX. 5 | 0.37 | 18.4 | 20.7 | 1.41 | 1.39 | ○ | ○ | ○ |
| REF. 9 | 0.73 | 19.7 | 32.1 | 1.37 | 1.05 | ○ | △ | ○ |

FIG. 13

| | AVERAGE SIZE [μm] | LOW TEMP. LOW HUMIDITY | | | | | | |
|---|---|---|---|---|---|---|---|---|
| | | CHARGE [μC/g] | | IMAGE DENSITY | | FOG | | SCATT-ERING |
| | | INITIAL | FINAL | INITIAL | FINAL | INITIAL | FINAL | FINAL |
| REF. 8 | 0.005 | 16.1 | 17.2 | 1.36 | 1.32 | ○ | △ | △ |
| EX. 4 | 0.05 | 19.0 | 20.1 | 1.41 | 1.40 | ○ | ○ | ○ |
| EX. 1 | 0.20 | 20.2 | 21.8 | 1.40 | 1.39 | ○ | ○ | ○ |
| EX. 5 | 0.37 | 21.3 | 23.1 | 1.37 | 1.34 | ○ | ○ | ○ |
| REF. 9 | 0.73 | 23.5 | 37.9 | 1.31 | 0.95 | ○ | △ | ○ |

MAGNETIC TONER FOR TWO COMPONENT DEVELOPER AND IMAGE FORMING METHOD USING THE SAME

BACKGROUND OF THE INVENTION (1) Field of the Invention

The present invention relates to a magnetic toner wherein a toner particle contains the magnetic particle and a binder resin and further the two component developer contains the toner particle and a carrier. Further, the present invention relates to the electro-photographic image forming method using the two component developer.

(2) Description of the Prior Art

In the electro-photographic image forming apparatuses such as laser printers, copiers, facsimiles and their hybrid apparatuses, first, the electrostatic latent image retaining member, i.e., a photoreceptor is electrically charged uniformly, second, the photoreceptor is exposed, thereby forming the electrostatic latent image, third, the latent image is developed by the toner, forth, the toner image is transferred onto the paper, or the intermediate transfer member, and finally the transferred toner image is fixed onto the paper.

Although there are dry and wet developing methods, the dry development is more widely employed than the wet development. Further, the dry developer is classified into two types. One of them is the magnetic toner wherein the magnetic particles are added internally or externally to the binder resin for the single component or two component developer. Other is the non-magnetic toner wherein the magnetic particles are not added.

Particularly, in the two component developer, the minute toner particles are attached to the relatively large-sized carrier particle such as iron or ferrite particle. The two component developer is carried to the photoconductor. When it comes near the latent image on the photoconductor, the toner particles are attached onto the photoconductor by the attractive force due to the latent image electric field which is stronger than the toner—carrier attractive force.

Further, the two component magnetic developer has an advantage that the toner scattering, the toner dropping and the fogging on the photoreceptor can be avoided, because the toner is attracted to the carrier by the magnetic force. Further, the two component magnetic developer has another advantage that the excessive charging of the magnetic toner due to the repetitive mixing of the magnetic toners and the carrier can be avoided by the charge leak from the magnetic particles.

Recently, the image forming process speed becomes farther higher and the image forming apparatus is made farther smaller-sized.

Particularly, the high speed apparatus for the business use should prevent the degradation of image resolution and quality. Accordingly, it is required to more rapidly rise up the electric charge quantity of the magnetic toner and moreover to stabilize the electric charge quantity.

Further, the smaller-sized middle and low speed apparatus for the small office and family use should farther shorten the warming-up time after switching on the apparatus, because the electric power supply is very often switched on and off. Accordingly, it is required to well and rapidly charge the magnetic toner when the power supply is switched on.

Further, regardless of the image forming speed, it is required to farther improve the image quality & resolution and the endurance & environmental stability of the magnetic toner.

However, the conventional magnetic toners generally used are not satisfactory in the current tendency seeking higher process speed and smaller-sized apparatus.

The magnetic particle is, in general, a sphere (see FIG. 1A) or a polyhedron such as a cube, a hexahedron (see FIG. 1B) or an octahedron (see FIG. 1C). Such a magnetic toner is tends to leak the electric charge, because the electric charge is easily leaked from the vertexes and edges of the polyhedron. Further, the magnetic polyhedrons do not well disperse.

Accordingly, the polyhedron magnetic toner has a disadvantage that the charge quantity does not rapidly rise up, resulting in a low charge quantity, the toner scattering & dropping and the image quality degradation such as the fogging in the image background. Further, it has another disadvantage that the image quality is farther degraded in the high temperature and high humidity environment where the electric charging becomes difficult.

On the contrary, the spherical magnetic particle has an advantage that the charge leak is not easily induced, because it does not have any vertex nor edgeline. Further, it has another advantage that it disperses in the binder resin more than the polyhedron particle, thereby preventing the fluctuation of the dispersion, the easiness of the electric charging and the charge quantity.

However, the spherical magnetic particle is easily charged so much that the charge-up is easily caused and the image quality degradation such as the low image density is easily induced.

Therefore, the various shaped magnetic particles are studied, in order to take in the shape merits of the sphere and polyhedron.

For example, there are disclosed in JP11-153882A (1999), JP2000-162817A and JP2000-242029A that the vertexes and edges of polyhedron are trimmed. However, pointed lines between the trimmed surfaces and the original polyhedron surfaces are left yet, thereby easily discharging from the pointed lines and therefore thereby possibly causing the low image density and the background fogging.

Further JP9-59024A, 1997 discloses that the edgelines of the polygon are rounded. However, it has a disadvantage that the magnetic toner is charged up similarly to the spherical magnetic toner, thereby possibly causing the image quality degradation.

Further, JP56-106249A (1981) and JP59-162563 (184) assert that the two component magnetic developer suppreses the toner scattering and the background fog. However, they does not disclose the endurance characteristics in the multiple times of the repetitive image forming processes. Accordingly, the electric charge quantity may not be stable after making a quite lot of copies.

SUMMARY OF THE INVENTION

An object of the present invention is to provide a magnetic toner which can maintain a proper quantity of the electric charges for the two component developer comprising of the magnetic toner and the carrier, in order to obtain an excellent image quality of the high image density and the low fogging in the high temperature and high humidity environment and in the low temperature and low humidity environment.

Further, another object of the present invention is to provide an image forming method using the magnetic toner which does not cause the toner scattering.

Further, other object of the present invention is to provide the two component developer which rapidly charges by the friction of the magnetic toners and the carrier but moreover does not excessively charges up.

First, the magnetic toner is of an average particle size 0.01 μm through 0.50 μm and is of octahedron shape that is a convex polyhedron surrounded by eight triangles as a basis, each of vertexes and edges of the octahedron shape toner being in a curved surface shape and having a portion that can be taken as a straight line on the outer periphery of a projected image of the octahedron shape toner.

Second, the image forming method comprises the steps of: forming an electrostatic latent image on a photoreceptor; electrically charging the above-mentioned magnetic toners; and developing the electrostatic latent image. Third, in the above-mentioned image forming method, the magnetic toners are attached on the magnetic carriers by magnetic force to form magnetic ears; and the magnetic ears approach or touch the photoconductor.

According to the magnetic toner of the present invention, first, the leak of the electric charge from the magnetic toners are suppressed and moreover the fluidity and dispersion of the magnetic toners are improved, because the vertexes and edges of octahedron shape toner are trimmed and are not sharply pointed. Further, the magnetic toner of the present invention has an advantage over the conventional cubic toner, because the surfaces of the octahedron intersects at an angle acuter than the cubic toner, thereby properly leaking electric charges, in other word, thereby suppressing the toner charge-up.

Second, according to the electro-photographic image forming method of the present invention, the magnetic toner of the present invention can be employed by the image forming method in general.

Third, according to the electro-photographic image forming method of the present invention, the magnetic toner of the present invention can be employed by the image forming method particularly utilizing the magnetic ear development (magnetic brush development).

BRIEF DESCRIPTION OF THE DRAWINGS

FIG. 5 through FIG. 13 show examples and references.

DETAILED DESCRIPTION OF THE PREFERRED EMBODIMENTS

Figure 1A:
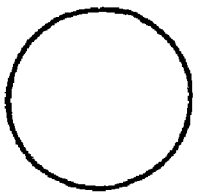
FIG. 1A PRIOR ART
FIG. 1A shows a conventional spherical magnetic particle.

Preferred embodiments of the present invention are explained, referring to the drawings. It should be understood that the present invention is not limited to specifically described sizes, materials and relative arrangements and so on regarding the constituent components.

The magnetic toner of the present invention comprises magnetic particles, binder resins, coloring agents, electric charge control agents, waxes and so on. Accordingly, the magnetic toner is explained on the material by material basis.

Magnetic Particle

Figure 1B:
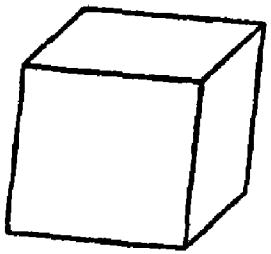
FIG. 1B PRIOR ART
FIG. 1B shows a conventional hexahedron magnetic particle.
Figure 1C:
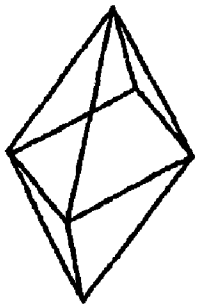
FIG. 1C PRIOR ART
FIG. 1C shows a conventional octahedron magnetic particle.
Figure 1D:
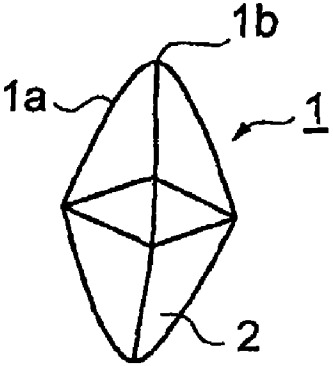
FIG. 1D shows a trimmed octahedron magnetic particle used for the magnetic toner of the present invention.

FIG. 1D shows a trimmed octahedron magnetic particle used for the magnetic toner of the present invention, while FIG. 1A shows a conventional sphere magnetic particle, FIG. 1B shows a conventional hexahedron magnetic particle and FIG. 1C shows a conventional octahedron magnetic particle.

Figure 2:
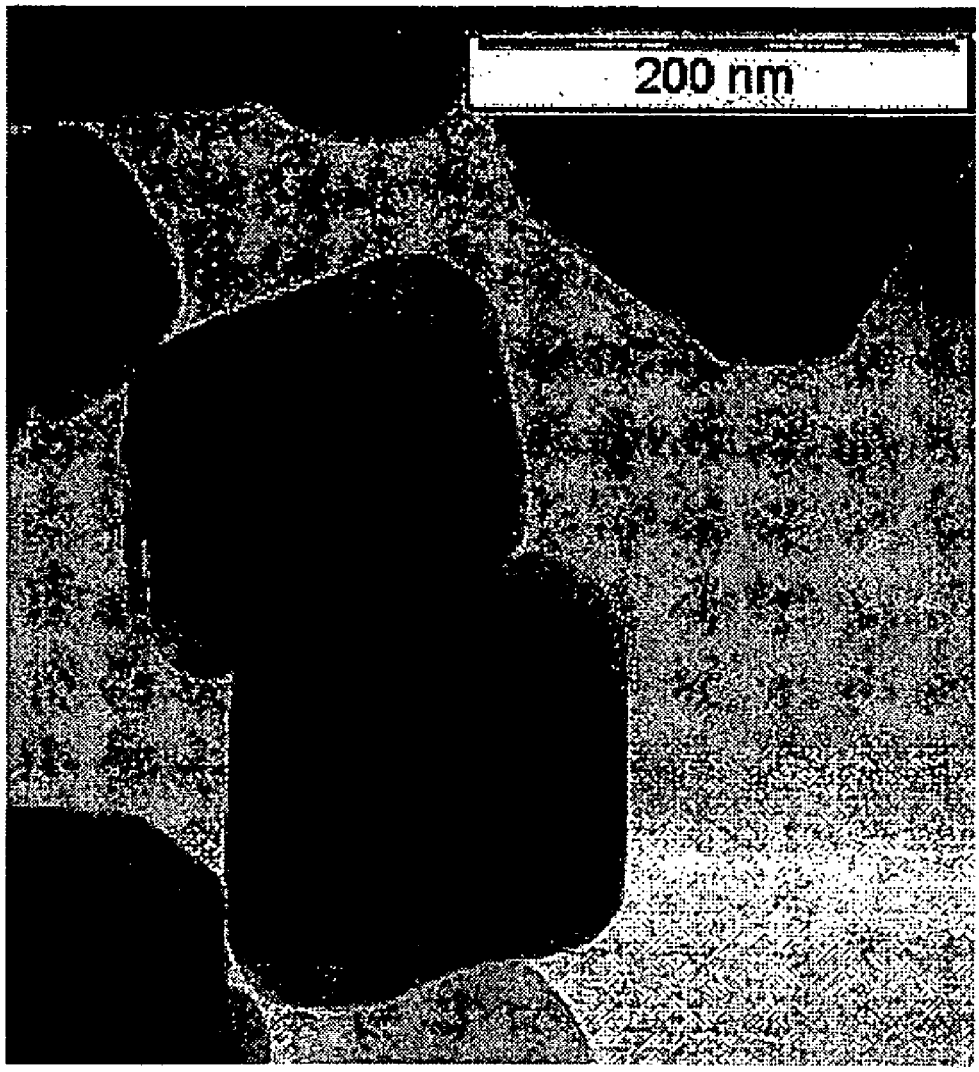
FIG. 2 is a TEM photograph of a magnetic toner of the present invention.

FIG. 2 is a TEM photograph of a magnification 10,000 of a magnetic toner of the present invention.

Figure 3A:
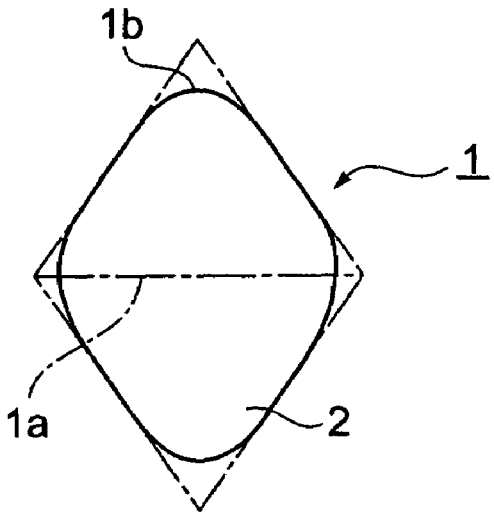
FIG. 3A is an elevational view of a magnetic particle for the magnetic toner of the present invention.
Figure 3B:
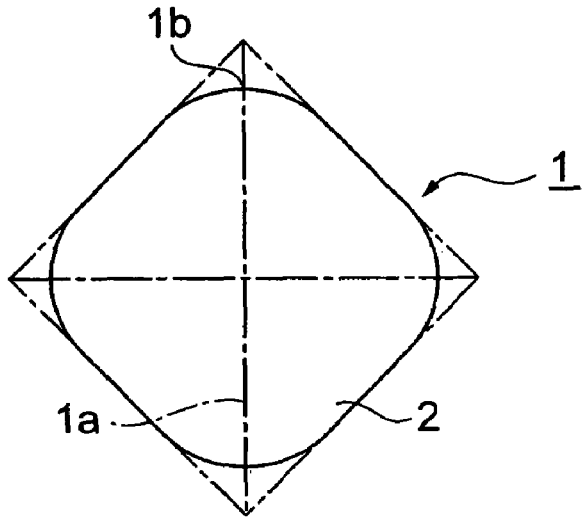
FIG. 3B is a side view of the magnetic particle and FIG. 3C is a plan view of the magnetic particle.
Figure 3C:
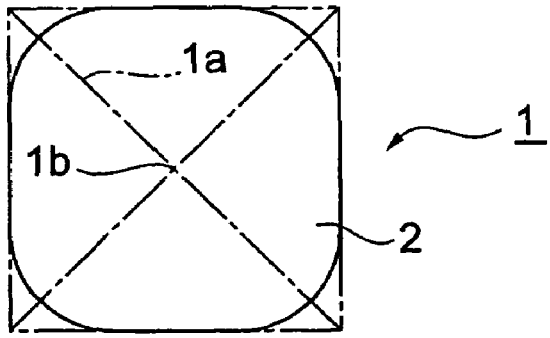

Referring to FIG. 3A through FIG. 3C, the magnetic toner for the two component developer is explained. FIG. 3A is an elevational view of the magnetic particle for the magnetic toner of the present invention, FIG. 3B is a side view of the magnetic particle and FIG. 3C is a plan view of the magnetic particle.

The magnetic particle of the present invention is an octahedral particle trimmed at its vertexes 1*b* and the edgelines 1*a*, characterized in that there is not any pointed vertexes nor any pointed edgelines from which the electric charges are excessively emitted.

However, its shape is far from a sphere. That is, the radius of curvature around the vertexes and the edgelines are not so great in such a manner that they are not continuously connected with each other. Therefore, there are, at the outer circumferences, such portions as could be deemed to be linear, in the TEM photograph as shown in FIG. 2.

The average particle size (particle diameter) of the magnetic particle should be between 0.01 μm and 0.50 μm. If it is smaller than 0.01 μm, the magnetic particles exposing from the toner surface are increased from which the electric charges are emitted, thereby causing poor charging and therefore causing the toner scattering. On the contrary, if it is greater than 0.50 μm, the electric charges are not properly discharged, thereby causing the charge-up and therefore causing the image density decrease after making a quite lot of copies. The average particle size is preferably between 0.05 μm and 0.30 μm, and is more preferably between 0.15 μm and 0.25 μm. Here, the average particle size is determined, for example, by the Martin diameters of, e.g., 300 particles, by using the TEM photograph enlarged by, e.g., four times.

The magnetic particle may be of ferromagnetic material such as Fe, Co and Ni and their alloys, nonmagnetic material alloys which are made ferromagnetic by a heat treatment, or compounds such as $CrO_2$ which does not contain any ferromagnetic material. Particularly, the ferrite or magnetite is preferable. The magnetite may preferably contain 100 at. % Fe and about 0.1 at. % through 10 at. % of at least one element selected from Mn, Zn, Ni, Cu, Al, Ti and Si.

Next, the manufacturing of the above-mentioned magnetite is explained.

First, 26.7 liter iron(II) sulfate salt aqueous solution containing 1.5 mol/liter $Fe^{2+}$ is added to 25.9 liter aqueous solution of 3.4 N sodium hydrate (1.10 equivalent weight per $Fe^{2+}$). The mixed solution is heated at pH 10.5, thereby making iron(II) sulfate salt suspension containing iron(II) hydrate colloid.

Second, 100 liter/minute air is blown into the 90° C. suspension for 80 minutes, thereby causing the oxidization reaction up to 60% reaction rate of iron(II) salt.

Third, sulfuric acid aqueous solution is added to the suspension, thereby making the pH of the suspension 6.5. Then, 100 liter/minute air is blown into the 90° C. suspension for 50 minutes, thereby generating the magnetite particles in the suspension.

Forth, sodium hydrate aqueous solution is added to the suspension containing the magnetite particles, thereby making the suspension pH 10.5. Then, 100 liter/minute air is blown into the 90° C. suspension for 20 minutes. Then, the generated magnetite particles are washed by water by a conventional method, thereby generating the magnetite particle in the suspension. Then, they are filtered, dried and pulverized.

Thus, the magnetite powder of the trimmed octahedral shape is obtained.

In general, the magnetite manufacturing may comprise a metal addition process and a pH control process. Various aqueous metal compounds such as silicic acid may be added to hydrate alkaline aqueous solution or aqueous solution containing iron(II) hydrate colloid, in such a manner that 0.1 at. % through 10 at. % of the various metals are added to 100 wt. % Fe. Further, in the pH control process in the metal addition process, the pH of the aqueous solution may be preferably maintained at pH 8.0 through 9.5, when the gas containing oxygen is blown in. The generated magnetic powder contains the magnetite which contains 100 at. % Fe and about 0.1 at. % through 10 at. % of at least one element selected from Mn, Zn, Ni, Cu, Al, Ti and Si.

Further, the radius of curvature around the vertexes and the edgelines is controlled by the reaction rate in the above-mentioned oxidization reaction rate.

Further, the magnetic powder is preferably of 1 wt. % through 35 wt. % and more preferably is 5 wt. % through 20 wt. %, for 100 wt. % resin. If the magnetic powder is lower than the lower limit, the magnets in the developing means cannot well hold the magnetic toners, thereby possibly causing the image background fogging and the toner scattering. On the other hand, if the magnetic powder is higher than the higher limit, the magnet fixed in the developing means excessively hold the magnetic toners, thereby possibly causing the image density decrease. Further, the toner is not well fixed onto the paper surface, because the content of the binder resin is lowered, compared with the magnetic particle.

Further, the surface of the magnetic powder may be treated by the titanium coupling agent, silane coupling agent, aluminum coupling agent or fatty acid surface treatment agent, taking into consideration its dispersion into the binder resin. Particularly, preferably are used the silane coupling agent such as: hexamethyldisilazane, trimethylsilane, trimethylethoxysilane, dimethyldichlorsilane, metyltrichlorsilane, allyldimethylchrolsilane, allylphenildichrolsilane, benzildimethylchrolsilane, brommethyldimetylchrolsilane, chrolmethyldimethylchrolsilane, α-chrolethyltrichrolsilane, β-chrolethyltrichrolsilane, chrolmethyldimethlchrolsilane, triorganosilanizingmercaptan, trimethylsilinizingmethylcaptan, triorganosilinizingacrylate, vinyldimethylacetokyxisilane, dimethyldiethoxisilane, dimethyldimetoxisilane, diphenylethoxisilane, hexamethyldisiloxane, 1,3-divinyltetramethylsiloxane, and 1,3-diphenyltetramethyldisiloxane.

Further, pereferably is used dimethylpolysiloxane which includes 2 through 12 unit siloxane and moreover one hydrate base connected with silicon element in the siloxane unit positioned at the ends.

Binder Resin

Preferable binder resins are polystyrene, acryl, polyethylene, polypropylene, polychrolvinyl, polyester, polyamid, polyurethane, polyvinylalcohol, vinylether, N-vinyl, and styrenebutadiene. Particularly, the polystyrene resin and polyester resin are preferable.

Further, the preferable polyethylene resins are polystyrene polymer, or double or triple copolymer of styrene and other monomer. Those preferable polyethylene resin are used alone or in a form of the copolymer of styrene and more than the two kinds.

Further, the preferable polyester resins are condensation polymer or copolymer of alcohol component and carboxylic acid component.

Further, the softening temperature of the polyester resin is preferably 80° C. through 150° C. and is more preferably 90° C. through 140° C., taking into consideration its fixation onto the paper by the conventional fixing means.

The binder resin is preferably cross-linked in part, thereby improving the preservation stability, the shape retaining and endurance, without lowering the fixing capability. The crosslink can be made by the cross-linking agent, or by adding the thermoplastic resin.

Here, the preferable thermoplastic resins are such as: bisphenolAepoxy, hydrogenatedbisphenolAepoxy, novolacepoxy, polyalalkyleneetherepoxy, cyclic fatty acid.

Further, on or more cyanate resin may be preferable.

The glass transition point of the binder resin is preferably 50° C. through 65° C., and may be more preferably 50° C. through 60° C. If it is lower than the lower limit, the toners are easily blocked with each other, thereby lowering the preservation stability. Further, the toners are easily attached onto the photoreceptor and can not be easily separated from the photoreceptor. On the contrary, if it is higher than the higher limit, the fixation capability may possibly be lowered.

The glass transition point is, for example, a point at which the specific heat is changed in an endotherm curve measured by the differential scanning calorimeter (DSC). Concretely, the endotherm curve of 10 mg sample in an aluminum pan is measured by the DSC-6200 made by Seiko Instruments Co. Ltd., under the conditions of the temperature ascend rate 10° C./min in the temperature range of 25° C. through 200° C. The reference is an empty aluminum pan.

Coloring Agent

Pigments such as carbon black, or dyes such as acid violet may be used. The preferable content may be 0.5 wt. % through 5 wt. %.

Charge Control Agent

The charge control agent improves the electrical charging level and the rapidity of the electrically charging, thereby obtaining the endurance and the stability of the charging.

One of the preferable positive electric charge control agents is nigrosine compound, because it rapidly rises up the charging. Further, preferable are the class $4^{th}$ ammonium salt, carboxylate and strlene-acryl copolymer having carboxyl group as functional group, because they are suitable for controlling the charge quantity.

The preferable negative electric charge control agents are organic metal complex, chelate compound, acetylacetone-metal complex and salicylic acid metal complex, because they are suitable for controlling the charge quantity.

The content of the electric charge control agent in the magnetic toner may be 0.5 wt. % through 15 wt. %, or may preferably be 0.5 wt. % through 8.0 and more preferably be wt. % 0.5 wt. % through 7.0 wt. %. If it is lower than the lower limit, the electric charging becomes unstable; the image density becomes lower; the endurance becomes lower; the image background fogging may possibly induced, due to the poor dispersion in the binder resin; and the contamination of the photoreceptor by the aggregated electric charge control agent may possibly induced. On the contrary, if it is higher than the higher limit, the environmental endurance, the poor charging under the high temperature & high humidity condition and the image quality degradation may possibly be induced. Further, the image background fogging may possibly induced, due to the poor dispersion in the binder resin. Further, the contamination of the photoreceptor by the aggregated electric charge control agent may possible be induced.

Wax

The wax improves the fixing capability of the magnetic toner onto the surface of the member printed such as a paper, prevents the magnetic toner from attaching on the fixing roller, i.e., prevents the toner offset, and prevents the image smearing wherein the magnetic toners once attached on the fixing roller are again attached on the member printed.

Magnetic Toner Manufacturing

The mixture of the magnetic particles, the binder resin, the electric charge control agent and so on as already explained is fused and kneaded. Then, it is cooled, powdered, filtered and classified. The volume average particle size (particle diameter) of the magnetic toner is preferably 3.0 μm through 10.0 μm and more preferably 5.0 μm through 10.0 μm. If it is smaller than the lower limit, the fluidity is lowered and the image background fogging ios induced. On the other hand, if it is greater than the higher limit, the image quality is degraded.

Further, the surface of the manufactured magnetic toner may be treated by the externally added agent of usually 1.0 μm average particle size such as colloidal silica, hydrophobic silica, aluma and titanium. The externally added agent is mixed with the magnetic particles preferably by the dry process. Particularly, in order to prevent the externally added agent from being buried from into the magnetic toner particle surface, the Henschel mixer or Nauter Mixer is preferably employed. Further, the content of the externally added agent in the magnetic toner particle is preferably 0.2 wt. % through 10.0 wt. %. Further, aminosilane, silicone oil, silane coupling agent such as hexamethyldisilazane, or titanium coupling agent is added if necessary.

Carrier

The carrier used for the two component developer may preferably be of the volume average particle size 20 μm through 150 μm and more preferably 20 μm through 100 μm, thereby obtaining a high image density even for the high speed apparatus, because the toner density of the developer layer becomes thick enough. The nucleus particle of the carrier may be of conventional ferromagnetic material such as Fe, Co and Ni; compound such as magnetite, hematite and ferrite; and mixture of resin and the ferromagnetic fine particle.

Further, the carrier particle is preferably coated by resin, in order to improve the endurance.

The preferable coating resins are such as: polyethylene, polypropylene, chlorinated polyethylene, polyolefine such as chlorosulfonated polyethylene, polystyrene, acryl such as polymethylmethacrylate, polyacrylnitryl, polyvynylacetate, polyvinyl alcohol, polyvinylbutylar, polyvinylchloride, polyvinylcarbazole, polyvinyether, polyvinyl such as polybiliketone and polyvinylidene; vinyl chloride-vynyl acetate copolymer; silicone resin having organosiloxane bond or its denaturation of alkid resin, polyester resin, epoxy resin, and polyurethane resin; polyamide; polyester; polyurethane; polycarbonate; amino resin such as urea-formaldehyde; and epoxy resin.

Further, there may be dispersed in the carrier the conventional electric conductive material such as metals, e.g., iron, gold, or copper; iron oxide such as ferrite and magnetite; and carbon black. Particularly, a small amount of mixture of furnace black and acetylene black facilitates to control effectively the carrier conductivity, whereby the coating layer becomes highly abrasion-resistant.

Further, there may be added in the carrier coating layer the silane coupling agent or the titanium coupling agent, in order to improve the adhesivity to the nucleous particle such as Fe and to improve the dispersion capability of the conductive material. The coating layer is made by a conventional method whereby the coating liquid is coated on the surface of the carrier nucleus particles by the atomization or the dipping. The coating layer thickness is preferably 0.1 μm through 20 μm and more preferably 0.2 μm through 5 μm The toner content for 100 wt. % carrier is preferably 2.0 wt. % through 20 wt. % and more preferably 3.0 wt. % through 15 wt. %. If it is lower than the lower limit, the charge-up is induced. On the other hand, if it is higher than the higher limit, the fogging and the toner scattering are induced.

Image Forming Method

Figure 4:
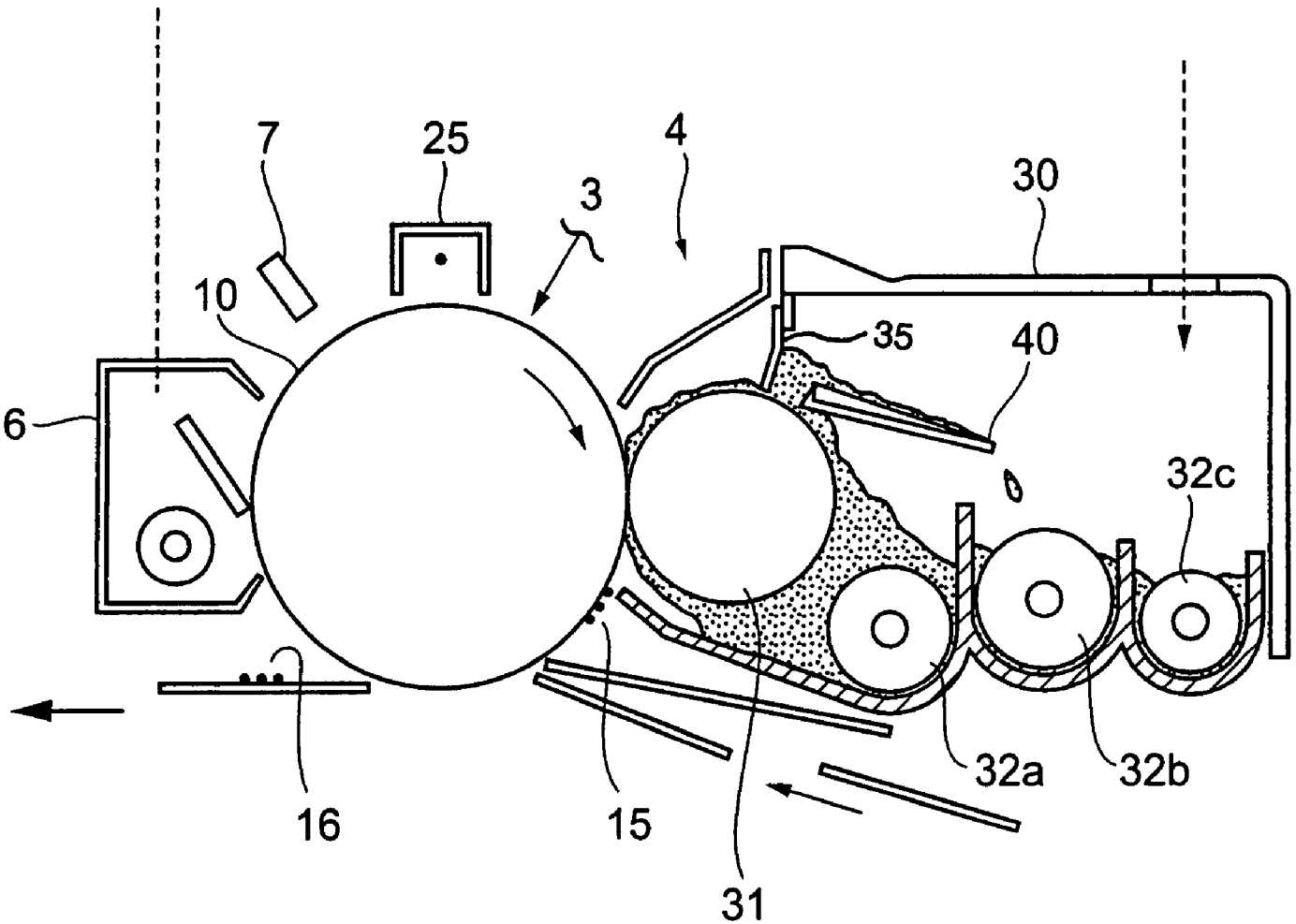
FIG. 4 is a schematic view of an imaging apparatus of the present invention.

The image forming method using the above-explained magnetic toner for the two component developer is explained, referring to FIG. 4 which is a schematic view of an exemplary image forming apparatus.

As shown in FIG. 4, around a photoreceptor drum 10, there are provided a charging unit 25, an exposing unit 3, magnetic brush developing unit 4, a not-shown transfer unit, a cleaning unit 6, discharging unit 7. The transfer member such as a paper an overhead projector (OHP) film passes through between the not-shown transfer unit and the photoreceptor drum 10. Further, the toner image on the transfer member is fixed by a not-shown fixing unit.

The surface of the photoreceptor drum 10 such as a conductive substrate made of, e.g., Al. Its surface is coated by an inorganic photoconductor layer (of, e.g., Se, am-Si), or by an organic photoconductor layer comprising a charge generation layer (of a charge generation agent dispersed in a binder resin) and a charge transport layer (of an charge transport agent dispersed in a binder resin).

The charging unit 25 is a contact charging roller, or a corotron, whereby the photoreceptor drum 10 is electrically charged uniformly at a prescribed polarity, in accordance to the kind of the photoreceptor. The charged electric potential on the surface of the photoreceptor ids usually 200V through 1,000 V in the absolute value.

After charging the photoconductor drum 10, the exposing unit 3 exposes the photoreceptor drum 10 by the reflected light from the original document, or by the laser beam modulated by the image signal, thereby forming the electrostatic latent image, because the electric potential at the exposed portion is dropped.

The magnetic brush developing unit 4 develops the latent image, thereby forming a toner image 15. Here, the developer is the already explained two component developer comprising the magnetic carrier and the magnetic toner. The two component developer forms the so-called magnetic brush (magnetic ears) and only the magnetic toner develops the latent image.

The toner image 16 transferred by the not-shown transfer unit is fixed by the heat and pressure by the not-shown fixing unit, thereby completing the printing process.

On the other hand, the magnetic toners left on the photoreceptor drum 10 is removed away by the cleaning unit 6. Then, the electric charges left on the photoreceptor drum 10 are removed by the discharging unit 7, thereby preparing the next image forming process.

The developing unit 4 is explained in farther detail. The developing unit 4 has a developing housing 30 which comprises: developing sleeve 31 which faces the photoreceptor drum 10; and stirring puddles 32*a*, 32*b* and 32*c* which are disposed in parallel to their axes.

The developing sleeve 31 has a plurality of not-shown magnets fixed in the developing sleeve 31. The magnets carries the two component developer in the form of the magnetic brush to the photoreceptor drum 10, when the developing sleeve 31 rotates. Here, the sleeve of the developing sleeve 31 may be fixed and moreover the magnets may be rotated. The gap between the developing sleeve 31 and the photoreceptor drum 10 may be 0.3 mm through 11.0 mm. In accordance with the above-mentioned sleeve-drum gap, an ear cutting blade 35 for cutting the ear of the magnetic brush is disposed at the above-mentioned distance of 0.3 mm through 1.0 mm from the developing sleeve 31. The two component developer drawn up by the developing sleeve 31 is intercepted by the ear cutting blade 35, thereby making the magnetic brush length (magnetic ear length) a prescribed length. Thus, the magnetic toner particles of the prescribed thickness are carried to the gap between the photoconductor drum 10 and the developing sleeve 31.

The stirring puddles 32*a*, 32*b* and 32*c* electrically charge, by the friction, the magnetic particles in the two component developer. In order to sufficiently charge the magnetic particles, the stirring puddles 32*a*, 32*b* and 32*c* adjacent with each other are separated by the partitions, except at their center portion and both ends, whereby the two component developers are carried along the puddle axial directions and come into and out of the center portions and both ends of the stirring puddles 32*a*, 32*b* and 32*c*, thereby efficiently causing the friction charging.

Further, there is disposed a toner recovering plate 40 at the side where the magnetic toners are intercepted by the ear cutting blade 35. The intercepted magnetic toners drop on the toner recovering plate 40 and flow down to the stirring puddle 32*b*. Thus, the recovered magnetic toners are again stirred and supplied to the developing sleeve 31.

The developing sleeve may be of conventional material and preferably of blasted stainless steel.

EXAMPLES

First, the preparation of the magnetic toner of volume average particle size (particle diameter) 7.0 μm is explained.

The binder resins were: 800 weight part of styrene-acryl copolymer (lower molecular weight peak 8000, higher molecular weight peak 130,000, glass transition point Tg 55° C.); 12 weight part of the magnetic particle; 4 weight of sasol wax (sasol wax H1, SASOL, Co. Ltd.); and 4 weight part of $4^{th}$ class ammonium salt (Pontron P-51, Orient Chemical Co. Ltd.) as the electric charge control agent. They were mixed by the Henschel mixer, were fused and kneaded by the 2-axis extruder. After cooling, the mixture was roughly ground by the Hummer mil and further was finely ground by the mechanical grinder. The particles were classified by the air flow classifier. The volume average particle size of the classified magnetic toner was 7.0 μm. Here, the magnetic particle was of trimmed octahedron that is a convex polyhedron surrounded by eight triangles and was of the volume average particle size 0.20 μm.

Second, the preparation of the above-mentioned magnetic particle in the above-mentioned magnetic toner is explained in farther detail. Iron(II) salt aqueous solution and alkaline-hydroxide aqueous solution were reacted, in order to obtain a solution containing iron(II) hydroxide colloid, in such a manner that the equivalent weight of the alkaline hydroxide aqueous solution was 0.08 through 0.99 for the iron(II) salt in the iron(II) salt solution. From the obtained solution, magnetite was generated at 70° C. through 100° C. Further, when the oxidization reaction rate of the iron exceeded 50%, the alkaline hydrate solution was added to the obtained solution, thereby obtaining pH 10 or more. Further, the obtained solution was heated at 70° C. through 100° C. and the oxygen containing gas was blown into the obtained solution, thereby obtaining the trimmed octahedron.

Third, the preparation of the binder resin A, B and the mixture of A and B is explained in farther detail.

In order to obtain the styrene-acryl copolymer A, 300 weight part xylene was introduced in a reactor with a thermometer, a stirrer and a nitrogen gas tube. Further, there were dropped, in the reactor, at 170° C., for 2 hours, a mixed monomer of 180 weight part styrene and 180 weight part n-butyl; 8.0 weight part polymerization initiator of di-tert-butylperooxyde; and 125 weight part xylene. After the dropping, the polymerization was completed at 170° C. for 1 hour. Then, the solvent was separated and the styrene-acryl copolymer A was obtained.

Further, in order to obtain the styrene-acryl copolymer B, polymerized was the mixed solution of a mixed monomer of 30 weight part styrene and 270 weight part n-butylacrylic acid; and 125 weight part xylene.

The above-mentioned binder resin of the above-explained 7.0 μm magnetic toner was a mixture of 75 wt. % resin A and 25 wt. % resin B.

Forth, the surface treatment of the above-mentioned 7.0 μm magnetic toner is explained in further detail.

There were attached, by the Henschel mixer, on the surface of the above-explained 7.0 μm magnetic toner, 1.0 weight part titanium oxide (EC-100, Chitan Industries Co. Ltd.) and 1.0 weight part silica (RA-200H, Nippon Aerosol Co. Ltd.). This is the magnetic toner of example 1 as explained later.

The magnetic toners of example 2 through 5 and references 1 through 9 are the same as example 1, except the magnetic particles.

Fifth, the preparation of the two component developer is explained in farther detail.

The two component developer was made by the Nauter mixer by mixing 10 weight part magnetic toner to 100 weight part ferrite carrier (volume average particle size 50 μm, volume specific resistance $10^7$ Ωcm, saturation magnetization 70 $Am^2/kg$).

Sixth, the measurement of the toner size distribution is explained in farther detail.

The Kohlter Counter Multisizer 3 (BeckmannKohlter Co. Ltd.) was employed, the electrolyte liquid was Isoton II ((BeckmannKohlter Co. Ltd.), and the aperture was 100 μm. The 10 mg sample in the solution of the above-mentioned electrlyte liquid and the surfactant was dispersed by the ultrasonic wave, in order to obtain the volume size distribution of the sample.

Seventh, the measurement of the carrier size distribution is explained in farther detail.

The laser diffraction scattering particle size distribution measurement apparatus LA-920 (Horiba Manufacturing Co. Ltd.) was employed. The range was 5 μm through 100 μm and the dispersion solvent was ethanol.

Here, the estimation method of the two component developer is explained.

The page printer LS-6020 (Kyocera Co. Ltd.) was modified for the two component developer, in order to estimate various characteristics such as image qualities (density, fogging), toner charge quantity and toner scattering.

The estimation results are shown in the tables as shown in FIG. 5 through FIG. 13 wherein the shapes of the magnetic particles were as follows.

| | | |
|---|---|---|
| T8 for example 1, | T8 for example 2, | T8 for example 3, |
| T8 for example 4, | T8 for example 5, | P4 for reference 3, |
| P8 for reference 1, | ST8 for reference 2, | SPH for reference 6, |
| ST4 for reference 4, | T4 for reference 5, | T8 for reference 9 |
| T8 for reference 7, | T8 for reference 8, | |

where

T8: octahedron trimmed around the vertexes and edges

P8: pointed octahedron (not-trimmed)

ST8: slightly trimmed octahedron (trimmed around the vertexes and edges by planes smaller than T8)

T4: cube trimmed around the vertexes and edges

P4: pointed cube (not-trimmed)

ST4: slightly trimmed cube (trimmed around the vertexes and edges by planes smaller than T-4)

SPH: (sphere)

Further, in FIG. 5 through FIG. 10, the sphericity is defined by C2/C1, where C1 is a circumferential length of an image projected on a plane and C2 is a circumferential length of an assumed circle area as same as that of the projected image.

Further, the environmental conditions were as follows.

| | |
|---|---|
| Normal temperature - normal humidity: | NTNH 20° C. 65% |
| High temperature - high humidity: | HTHH 33° C. 85% |
| Low temperature - low humidity: | LTLH 10° C. 20% |

Further, the printed image of ISO 4% image was made by the above-mentioned page printer. The initial image is the first print, while the final image is the 100,000$^{th}$ print after the continuous printing.

Further, the image quality was estimated by the image density of the solid part measured by the Macbeth reflection densitometer RD914. The density is estimated to be good, if it is higher than 1.30.

Further, the background fog was estimated by the human eyes. The estimation result were classified into ○ (no fog), Δ (a little fog), x (terrible fog).

Further, the toner charge quantity (μC/g) was measured by the Trek absorption type charge measurement apparatus Q/Mmetet 210HS. The initial charge quantity is the charge after the first print, while the final charge is the charge after the 100,000$^{th}$ print after the continuous printing.

Further, the toner scattering from the developing unit was estimated by the human eyes. The estimation result were classified into ○ (no scattering), Δ (a little scattering, the inside of the printer was contaminated, but no influence to the image), x (scattering was caused, the scattered toners were exhausted from the fan, the scattered toners were attached on the paper path and the image was contaminated.)

Here, the estimation result is explained, referring to FIG. 5 through FIG. 12.

In example 1 through example 5, the magnetic particles were T8. The image qualities (density and fog) were excellent and no fog was recognized, after 100,000 prints, under NTNH<HTHH and LTLH environments.

In reference 1 through reference 4, the magnetic particles were P8, ST8, P4 and ST4, respectively. The electric charge did not rise up rapidly and the background fog & the background fog were induced, due to acute or slightly pointed vertexes and edges.

In reference 5 and reference 6, the magnetic particles were T4 and SPH, respectively. The toners were excessively charged and the image density were greatly lowered.

In reference 8, the magnetic particle was T8, but of the smallest size. At the final print and under NTNH environment, the charge was decreased, the fog was recognized a little, the toner scattering was terrible. Further, at the final print and under HTHH environment, the charge was decreased the fog and the toner scattering were terrible.

In reference 9, the magnetic particle was T8, but was of the largest size. At the final print and under NTNH environment, the charge was increased, and no fog nor toner scattering was recognized. Further, at the final print and under HTHH environment, the charge was increased, the fog was recognized a little and the toner scattering was not recognized.

What is claimed is:

1. Magnetic toner for two component developer comprising said magnetic toner and a carrier, wherein said magnetic toner comprises magnetic particles of an average particle size 0.01 μm through 0.50 μm and of octahedron shape that is a convex polyhedron surrounded by eight triangles as a basis, each of vertexes and edges of the octahedron shape toner being in a curved surface shape and having a portion that can be taken as a straight line on the outer periphery of a projected image of said octahedron shape toner.

2. An electro-photographic image forming method, which comprises the steps of:

forming an electrostatic latent image on a photoreceptor;

electrically charging magnetic toners; and developing said electrostatic latent image, wherein:

said magnetic toners are mixed with magnetic carriers; and said magnetic toners comprise magnetic particles of average particle size 0.01 μm through 0.50 μm and of octahedron shape that is a convex polyhedron surrounded by eight triangles as a basis, each of vertexes and edges of the octahedron shape toner being in a curved surface shape and having a portion that can be taken as a straight line on the outer periphery of a projected image of said octahedron shape toner.

3. The electro-photographic image forming method according to claim 2, wherein:

said magnetic toners are attached on said magnetic carriers by magnetic force to form magnetic ears; and said magnetic ears approach or touch said photoconductor.

4. Magnetic toner according to claim 1, additionally comprising a binder resin.

5. Magnetic toner according to claim 4, wherein said binder resin is a styrene-acryl copolymer.

6. Magnetic toner according to claim 1, wherein the average particle size of the magnetic particles is from 0.05 μm to 0.30 μm.

7. Magnetic toner according to claim 1, wherein the average particle size of the magnetic particles is from 0.15 μm to 0.25 μm.

8. Magnetic toner according to claim 1, wherein the carrier has a volume average particle size from 20 μm to 150 μm.

9. Magnetic toner according to claim 1, wherein the carrier has a volume average particle size from 20 μm to 100 μm.

10. Magnetic toner according to claim 1, additional comprising colloidal silica.

11. Magnetic toner according to claim 1, additionally comprising titanium oxide.

12. Magnetic toner according to claim 1, wherein the volume average particle size of the magnetic toner is from 3.0 μm to 10.0 μm.

13. Magnetic toner according to claim 1, wherein the volume average particle size of the magnetic toner is from 5.0 μm to 10.0 μm.

* * * * *